US008448537B2

(12) United States Patent
Nagaoka et al.

(10) Patent No.: US 8,448,537 B2
(45) Date of Patent: May 28, 2013

(54) ROTATING LEVER POSITION HOLDING APPARATUS

(75) Inventors: Tomoharu Nagaoka, Kanagawa (JP); Takao Taga, Kanagawa (JP)

(73) Assignee: Mitsui Kinzoku Act Corporation, Kanagawa (JP)

( * ) Notice: Subject to any disclaimer, the term of this patent is extended or adjusted under 35 U.S.C. 154(b) by 125 days.

(21) Appl. No.: 13/077,140

(22) Filed: Mar. 31, 2011

(65) Prior Publication Data

US 2011/0247447 A1 Oct. 13, 2011

(30) Foreign Application Priority Data

Apr. 8, 2010 (JP) ..... 2010-89599

(51) Int. Cl.
*G05G 1/00* (2008.04)

(52) U.S. Cl.
CPC ..... *G05G 1/00* (2013.01)
USPC ..... 74/519

(58) Field of Classification Search
CPC ..... G05G 1/00
USPC ..... 74/526–528, 473.1, 96, 519
IPC ..... G05G 5/06
See application file for complete search history.

(56) References Cited

U.S. PATENT DOCUMENTS 4,273,455 A * 6/1981 Gubelmann et al. ..... 400/309
4,651,583 A * 3/1987 Suzuki ..... 74/96
4,827,792 A * 5/1989 Uetake et al. ..... 74/473.1
5,187,999 A * 2/1993 Kobayashi et al. ..... 74/528
2004/0069028 A1* 4/2004 Dimig et al. ..... 70/277

FOREIGN PATENT DOCUMENTS

JP 59-130121 9/1984
JP 1-142023 9/1989
JP 2002-132363 A 5/2002

OTHER PUBLICATIONS

Decision of Patent Grant Japanese Patent Application No. 2010-089599 dated Jun. 20, 2012.
Notification of Reason for Refusal Japanese Patent Application No. 2010-089599 dated Feb. 17, 2012.

* cited by examiner

*Primary Examiner* — Vinh Luong
(74) *Attorney, Agent, or Firm* — Foley & Lardner, LLP

(57) ABSTRACT

A spring includes a coil portion and first and second arms. The coil portion is supported around a support portion of a base member. The first arm includes a projecting portion that slides the engagement projecting portion in association with rotation of the rotating lever and presses the rotating lever in a direction in which the rotating lever abuts a first stopper portion when the rotating lever is in a first position and in which the rotating lever abuts a second stopper portion when the rotating lever is in a second position. The second arm abuts a spring stopper portion of the base member in a state where a load is exerted in a direction in which the coil portion is wound so that an inner circumferential surface of the coil portion is pressed against an outer circumferential surface of the support portion facing the engagement projecting portion.

2 Claims, 5 Drawing Sheets

ROTATING LEVER POSITION HOLDING APPARATUS

CROSS-REFERENCE TO RELATED APPLICATIONS

This application claims priority from Japanese Patent Application No. 2010-089599 filed on Apr. 8, 2010, the entire subject matter of which is incorporated herein by reference.

BACKGROUND OF THE INVENTION

1. Field of the Invention

The present invention relates to a rotating lever position holding apparatus for holding a rotating lever in two positions.

2. Description of the Related Art

In a related-art rotating lever position holding apparatus, as shown in Japanese Patent No. 4277441, a spring for applying a pressing force in rotating directions to a rotating lever has: a coil portion which is placed around a support portion (a boss portion) which is set up on a base member so as to be supported; a pair of arm portions which extend from the coil portion and face each other across an engagement portion formed on the rotating lever; and a projecting portion. The projecting portion is formed on the pair of arms and with which the engagement portion is brought into engagement while riding thereover to forcibly extend the pair of arm portions when it moves along an arc-shaped locus in association with a rotation of the rotating lever so that when the rotating lever is in a first position. The projecting portion deflects the pair of arm portions so as to press the rotating lever in a direction in which the rotating lever is brought into abutment with a first stopper portion, while when the rotating lever is in a second position, the projecting portion deflects the pair of arm portions so as to press the rotating lever in a direction in which the rotating lever is brought into abutment with a second stopper portion.

In the above-described related-art rotating lever position holding apparatus, however, when the pressing force that is applied to the rotating lever by the engagement portion of the rotating lever which rides over the projecting portion of the spring is reversed, the coil portion moves in an opposite direction to the rotating direction of the rotating lever around the support portion to thereby be brought into abutment with the support portion due to the influence of a reaction force applied to the spring, whereby there is caused a fear that abnormal noise (like small knocking noise) is generated in association with the rotation of the rotating lever.

SUMMARY OF THE INVENTION

One object of the invention is to provide a rotating lever position holding apparatus which can prevent generation of abnormal noise resulting from the abutment of a coil portion of a spring with a support portion.

According to a first aspect of the invention, there is provided a rotating lever position holding apparatus comprising: a base member comprising a first stopper portion and a second stopper portion; a rotating lever, which is pivotally supported on the base member, and which is rotatable between a first position where the rotating lever is brought into abutment with the first stopper portion and a second position where the rotating lever is brought into abutment with the second stopper portion; and a spring, which is supported on the base member, and which comprises a coil portion, a first arm and a second arm, wherein the first arm and the second arm extend tangentially from the coil portion, wherein the rotating lever comprises an engagement projecting portion, wherein the base member comprises: a support portion, which is projected from the base member, and which is set up in a direction in which the engagement projecting portion of the rotating lever approaches when the rotating lever rotates from the second position to the first position; and a spring stopper portion, wherein the coil portion is supported around the support portion, wherein the first arm extends along a traveling locus of the engagement projecting portion along which the engagement projecting portion travels as the rotating lever rotates, wherein the first arm comprises a projecting portion, along which the engagement projecting portion slides in association with rotation of the rotating lever, and which configured to: press the rotating lever in a direction in which the rotating lever is brought into abutment with the first stopper portion when the rotating lever is situated in the first position; and press the rotating lever in a direction in which the rotating lever is brought into abutment with the second stopper portion when the rotating lever is situated in the second position, and wherein the second arm is brought into abutment with the spring stopper portion of the base member in such a state that a load is exerted in a direction in which the coil portion is wound so that an inner circumferential surface of the coil portion is pressed against an outer circumferential surface of a side of the support portion which faces the engagement projecting portion.

According to a second aspect of the invention, in the rotating lever position holding apparatus, wherein the base member comprises an assembling stopper portion with which the first arm of the spring is brought into abutment in such a state that a load is exerted in the direction in which the coil portion is wound so as to prevent the spring from rotating around the support portion when the rotating lever is not assembled onto the base member.

According to the aspects of the invention, the inner circumferential surface of the coil portion of the spring is held in such a state that it is pressed against the outer circumferential surface of the support portion on the base member at all times. Therefore, the coil portion of the spring can be restrained from moving around the support portion, and thus it is possible to prevent the generation of abnormal noise when the rotating lever is rotated.

DETAILED DESCRIPTION OF THE PREFERRED EMBODIMENTS

Figure 1:
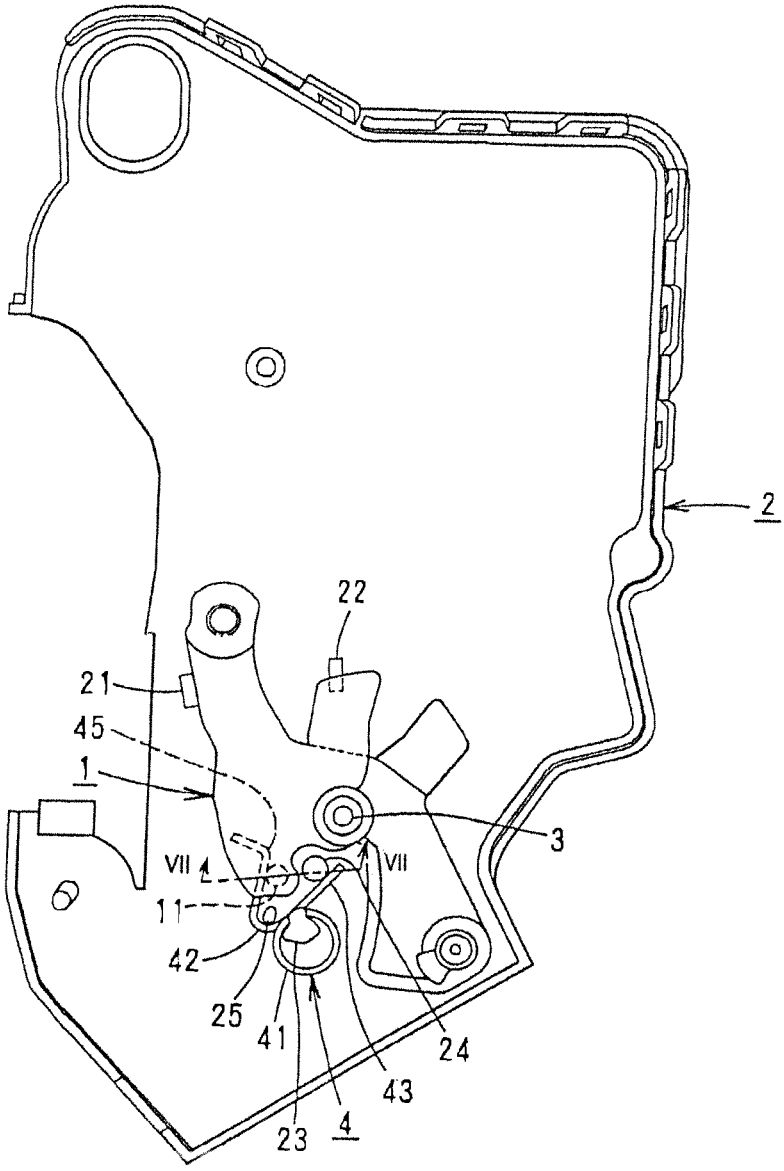
FIG. 1 is a front view of a door latch apparatus showing an example in which a rotating lever position holding apparatus according to the invention is applied thereto.

Hereinafter, an embodiment of the invention will be described based on the drawings.

A rotating lever 1 is pivotally supported on a base member 2 of a vehicle door latch apparatus by a shaft 3 so as to rotate freely around the shaft 3. The rotating lever 1 is able to rotate in a reciprocating fashion between a first position (an unlocking position) shown in FIG. 2 where the rotating lever 1 is brought into abutment with a first stopper portion 21 provided on the base member 2 to thereby be prevented from rotating in a counterclockwise direction and a second position (a locking position) shown in FIG. 3 where the rotating lever 1 is brought into abutment with a second stopper portion 22 provided on the base member 2 to thereby be prevented from rotating in a clockwise direction. The rotating lever 1 includes an engagement projecting portion 11 which is provided in a position which is spaced a predetermined distance apart from a rotational center (the shaft 3) obliquely downwards to the left so as to project towards the base member 2 in a cylindrical fashion.

In this embodiment, while a rotating lever position holding apparatus according to the invention is described as being applied to the vehicle door latch apparatus, the invention is not limited to the embodiment but can be applied to other applications than the vehicle door latch apparatus.

The base member 2 includes a support portion 23, a spring stopper portion 24 and an assembling stopper portion 25. The support portion 23 is projected from the base member 2 and supports a coil portion 41 of a spring 4 for applying a pressing force to the rotating lever 1 in a rotating direction thereof. A second arm 43 of the spring 4 can be brought into abutment with the spring stopper portion 24 so that the coil portion 41 is strongly pressed against an outer circumferential surface of the support portion 23. A first arm 42 of the spring 4 can be brought into abutment with the assembling stopper portion 25. The spring 4 will be described in detail later.

Figure 5:
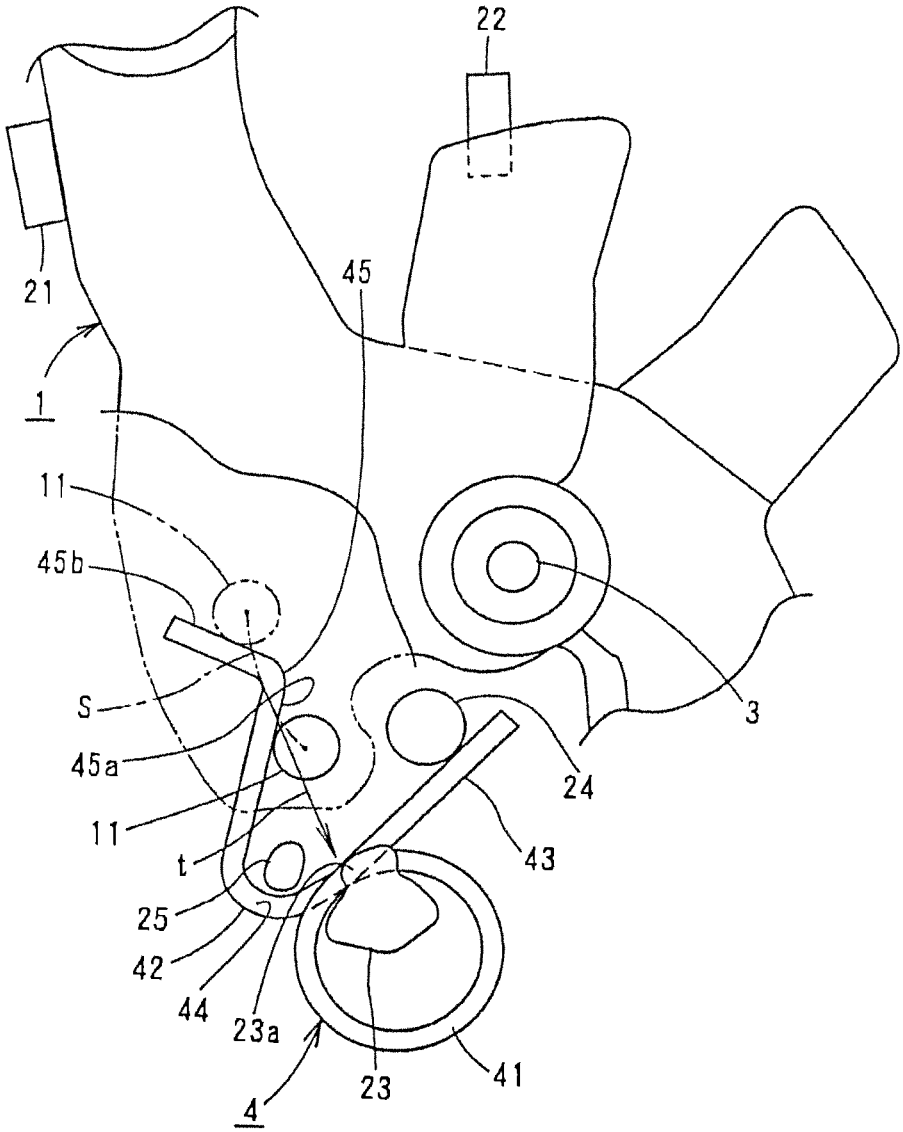
FIG. 5 is an enlarged front view of a main part of the rotating lever position holding apparatus according to the invention.

The support portion 23 is situated in a position which is spaced downwards a predetermined distance apart from the rotational center (the shaft 3) of the rotating lever 1 and, as clearly shown in FIG. 5, in the direction of a directional vector t (a directional vector when the rotating lever rotates in the counterclockwise direction) of a tangent to an arc-shaped locus S (a traveling locus of the engagement projecting portion 11 in association with the rotation of the rotating lever 1) when the tangent touches a substantially intermediate position of a rotating range of the rotating lever 1. Consequently, the engagement projecting portion 11 of the rotating lever 1 approaches the support portion 23 as the rotating lever 1 rotates from the second position to the first position.

The spring stopper portion 24 is situated in a substantially intermediate position between the rotating center (the shaft 3) of the rotating lever 1 and the support portion 23 and is provided closer to the rotating center (the shaft 3) of the rotating lever 1 than the arc-shaped locus S of the engagement projecting portion 11.

The assembling stopper portion 25 is situated in a position which lies farther away from the rotating center (the shaft 3) of the rotating lever 1 than the spring stopper portion 24 and is provided near to a left-hand side of the support portion 23.

A collar portion 23*a* is provided at a distal end portion of the support portion 23 to prevent the dislodgement of the coil portion 41 of the spring 4 from a distal end of the support portion 23 in such a state that the coil portion 41 is supported around the support portion 23.

In this embodiment, while the first and second stopper portions 21, 22, the support portion 23, the spring stopper portion 24 and the assembling stopper portion 25 are described as being provided integrally on the base member 2, the invention is not limited to the embodiment. A configuration may be adopted in which all or at least one of the first and second stopper portions 21, 22, the support portion 23, the spring stopper portion 24 and the assembling stopper portion 25 is formed separately from the base member 2 so as to be fixed to the base member 2.

The spring 4 is formed of a wire material. The spring 4 includes the coil portion 41 which is supported around the support portion 23, the first arm 42 which slightly extends from the coil portion 41 tangentially in a counterclockwise direction and then extends upwards (a direction along the arc-shaped locus of the engagement projecting portion 11), and the second arm 43 which extends from the coil portion 41 tangentially in a clockwise direction.

The first arm 42 has at a root portion thereof a curved abutment portion 44 which can be brought into abutment with the assembling stopper portion 25. The first arm 42 also has a projecting portion 45 at a portion which extends along the arc-shaped locus S of the engagement projecting portion 11. The projecting portion 45 projects angularly towards the rotating center (the shaft 3) of the rotating lever 1. As the rotating lever 1 rotates, the engagement projecting portion 11 slides along first and second sloping portions 45*a*, 45*b*, which are provided on the projecting portion 45, while deflecting the first arm 42 to the left (in a direction in which the coil portion 41 is wound in the counterclockwise direction).

Figure 6:
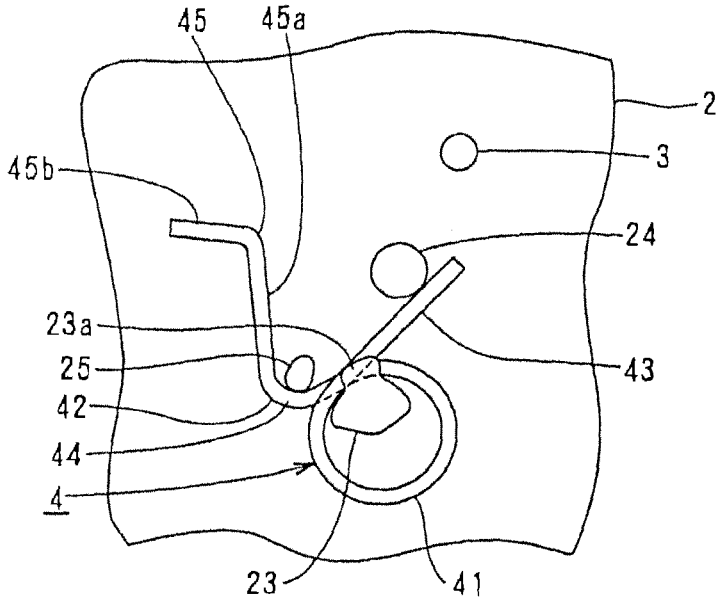
FIG. 6 is a front view of part of the rotating lever position holding apparatus according to the invention showing a state in which the rotating lever is not assembled thereto.

As shown in FIG. 6, with the rotating lever 1 not assembled yet onto the base member 2, the curved abutment portion 44 of the first arm 42 is brought into abutment with the assembling stopper portion 25 in such a state that a load is applied in the direction in which the coil portion 41 is wound in the counterclockwise direction, and in such a state that the rotating lever 1 is pivotally supported on the base member 2 with the engagement projecting portion 11 in abutment with the projecting portion 45 of the spring 4, the curved abutment portion 44 moves apart from the assembling stopper portion 25.

The second arm 43 extends straight obliquely upwards to the right so as to intersect an extension extended in the counterclockwise direction from the arc-shaped locus S of the engagement projecting portion 11 and is brought into abutment with the spring stopper portion 24 in such a state that a load is applied in a direction in which the coil portion 41 is wound in the clockwise direction. By this configuration, the coil portion 41 is pressed in the counterclockwise direction about an abutment point between the spring stopper portion 24 and the second arm 43 as a fulcrum, and an inner circumferential portion of the coil portion 41 is pressed against an outer circumferential surface of an outer circumferential portion of the support portion 23 which faces the direction of the directional vector t, that is, an outer circumferential surface of a side of the support portion 23 which faces the engagement projecting portion 11 at all times.

Next, an assembling procedure of the spring 4 and the rotating lever 1 onto the base member 2 will be described in an order that actually occurs.

Figure 7:
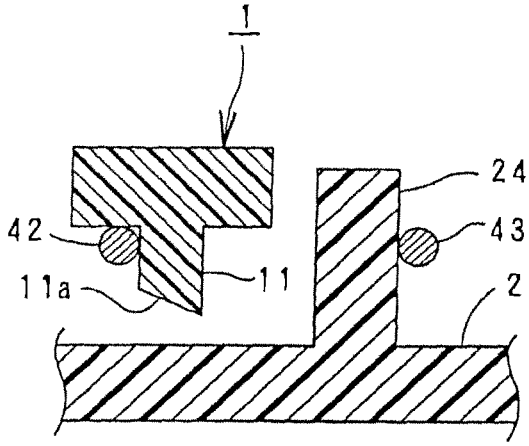
FIG. 7 is a sectional view taken along the line VII-VII in FIG. 1.

As shown in FIG. 6, before the rotating lever 1 is assembled onto the base member 2, the spring 4 is assembled onto the base member 2 in advance in such a state that the coil portion 41 is supported around the support portion 23, the curved abutment portion 44 of the first arm 42 is brought into abutment with the assembling stopper portion 25 and the second arm 43 is brought into abutment with the spring stopper portion 24. By the spring 4 being assembled onto the base member 2 in advance in the way described above, the spring 4 is prevented from rotating around the support portion 23 so as to be held in the assembling position in an ensured fashion. Next, as shown in FIG. 7, the rotating lever 1 is pivotally supported on the base member 2 by the shaft 3 in such a state that a sloping portion 11*a* of the engagement projecting portion 11 is brought into abutment with the first sloping portion 45*a* of the projecting portion 45 of the spring 4 so as to deflect the first arm 42 slightly to the left. As a result, the curved abutment portion 44 of the first arm 42 of the spring 4 slightly moves away from the assembling stopper portion 25 in such a state that the rotating lever 1 is pivotally supported on the base member 2.

Next, the operation of the embodiment will be described.

Figure 2:
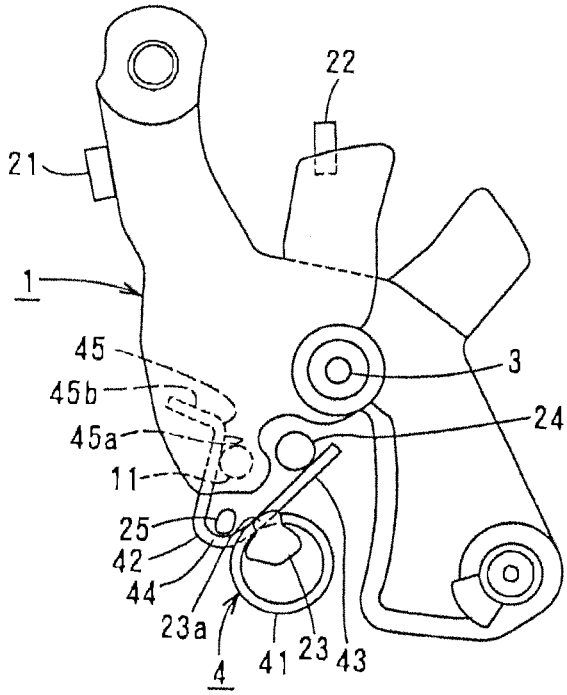
FIG. 2 is a front view of the rotating lever position holding apparatus according to the invention showing a state in which a rotating lever is held in a first position.

FIG. 2 shows a state in which the rotating lever 1 is situated in the first position. As shown in FIG. 2, the engagement projecting portion 11 of the rotating lever 1 is in abutment with the first sloping portion 45*a* of the projecting portion 45 of the first arm 42 of the spring 4, and the rotating lever 1 is pressed in the counterclockwise direction and is held in the first position where the rotating lever 1 is in abutment with the first stopper portion 21. The inner circumferential surface of the coil portion 41 of the spring 4 is pressed against the outer circumferential surface of the side of the support portion 23 which faces the directional vector t by virtue of the pressing force of the second arm 43 which is in abutment with the spring stopper portion 24.

Figure 4:
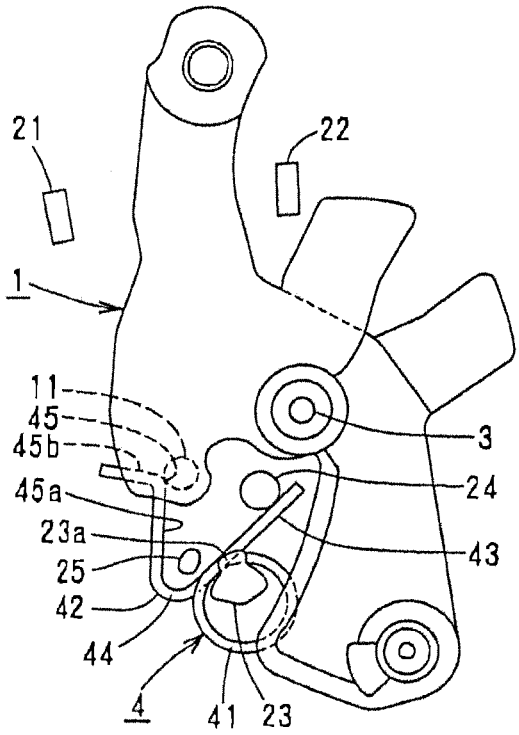
FIG. 4 is a front view of the rotating lever position holding apparatus according to the invention showing an operating state of the rotating lever.

When the rotating lever 1 is rotated in the clockwise direction in FIG. 2 from the state in which the rotating lever 1 is held in the first position, the engagement projecting portion 11 slides along the first sloping portion 45*a* while deflecting the first arm 42 to the left (in the direction in which the coil portion 41 is wound), and when the engagement projecting portion 11 reaches the substantially intermediate position between the first position and the second position (the rotating range), as shown in FIG. 4, the engagement projecting portion 11 is brought into abutment with an apex portion of the projecting portion 45. When the rotating lever 1 is rotated further in the clockwise direction from this state, and upon the engagement projecting portion 11 riding over the projecting portion 45 to reach the second sloping portion 45*b*, the direction of the pressing force of the spring 4 exerted on the rotating lever 1 is reversed from the counterclockwise direction to the clockwise direction. Then, as shown in FIG. 2, the rotating lever 1 is pressed in the clockwise direction by virtue of the pressing force of the first arm 42 and is held in the second position where the rotating lever 1 is in abutment with the second stopper portion 22. Even in this case, the inner circumferential surface of the coil portion 41 of the spring 4 is pressed against the support portion 23 at all times.

Figure 3:
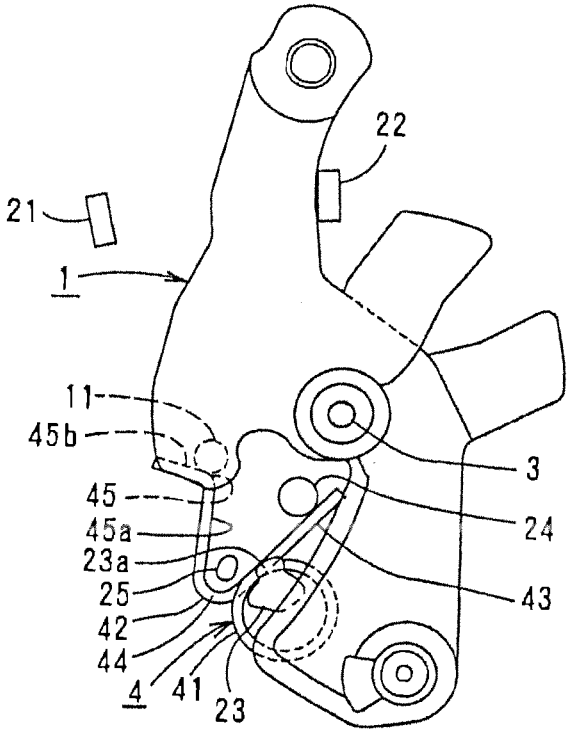
FIG. 3 is a front view of the rotating lever position holding apparatus according to the invention showing a state in which the rotating lever is held in a second position.

FIG. 3 shows a state in which the rotating lever 1 is situated in the second position. As shown in FIG. 3, the engagement projecting portion 11 of the rotating lever 1 is in abutment with the second sloping portion 45*b* of the projecting portion 45 of the first arm 42 of the spring 4, and the rotating lever 1 is pressed in the clockwise direction and is held in the second position where the engagement projecting portion 11 is in abutment with the second stopper portion 22. The inner circumferential surface of the coil portion 41 of the spring 4 is pressed against the outer circumferential surface of the side of the support portion 23 which faces the directional vector t by virtue of the pressing force of the second arm 43 which is in abutment with the spring stopper portion 24 as when the rotating lever 1 is situated in the first position.

When the rotating lever 1 is rotated in the counterclockwise direction in FIG. 3 from the state in which the rotating lever 1 is held in the second position, the engagement projecting portion 11 slides along the second sloping portion 45*b* while deflecting the first arm 42 to the left (in the direction in which the coil portion 41 is wound), and when it reaches the substantially intermediate position between the first position and the second position (the rotating range), as shown in FIG. 4, the engagement projecting portion 11 is brought into abutment with the apex portion of the projecting portion 45. When the rotating lever 1 is rotated further in the counterclockwise direction from this state, and upon the engagement projecting portion 11 riding over the projecting portion 45 to reach the first sloping portion 45*a*, the direction of the pressing force of the spring 4 exerted on the rotating lever 1 is reversed from the clockwise direction to the counterclockwise direction. Then, as shown in FIG. 2, the rotating lever 1 is pressed in the clockwise direction by virtue of the pressing force of the first arm 42 and is held in the first position where the rotating lever 1 is in abutment with the first stopper portion 21. Also in this case, the inner circumferential surface of the coil portion 41 of the spring 4 is pressed against the support portion 23 at all times even.

In the related art, the coil portion 41 moves around the support portion 23 in the direction of the directional vector t and the opposite direction by virtue of the reaction force exerted on the spring 4 when the pressing direction is reversed. As a result of this movement, the coil portion 41 of the spring 4 is forcibly brought into abutment with the outer circumferential surface of the support portion 23, causing the fear that abutment noise is generated when the rotating lever 1 rotates.

On the other hand, according to the embodiment of the invention, the inner circumferential surface of the coil portion 41 is pressed against the outer circumferential surface of the support portion 23 at all times by virtue of the pressing force of the second arm 43 which is in abutment with the spring stopper portion 24. Thus, when the direction of the pressing force of the spring 4 exerted on the rotating lever 1 is reversed, there occurs no such situation that the coil portion 41 moves around the support portion 23 in the direction of the directional vector t and the opposite direction. Therefore, it is possible to prevent the generation of abnormal noise when the rotating lever 1 rotates.

What is claimed is:

1. A rotating lever position holding apparatus comprising:

a base member comprising a first stopper portion and a second stopper portion;

a rotating lever, which is pivotally supported on the base member, and which is rotatable between a first position where the rotating lever is brought into abutment with the first stopper portion and a second position where the rotating lever is brought into abutment with the second stopper portion; and a spring, which is supported on the base member, and which comprises a coil portion, a first arm and a second arm, wherein the first arm and the second arm extend tangentially from the coil portion, wherein the rotating lever comprises an engagement projecting portion, wherein the base member comprises:

a support portion, which is projected from the base member, and which is set up in a direction in which the engagement projecting portion of the rotating lever approaches when the rotating lever rotates from the second position to the first position; and a spring stopper portion, which is provided in a substantially intermediate position between a rotating center of the rotating lever and the support portion, and which is provided closer to the rotating center of the rotating lever than an arc-shaped locus of the engagement projecting portion, wherein the coil portion is supported around the support portion, wherein the first arm extends along a traveling locus of the engagement projecting portion along which the engagement projecting portion travels as the rotating lever rotates, wherein the first arm comprises a projecting portion, along which the engagement projecting portion slides in association with rotation of the rotating lever, and which is configured to:

press the rotating lever in a direction in which the rotating lever is brought into abutment with the first stopper portion when the rotating lever is situated in the first position; and press the rotating lever in a direction in which the rotating lever is brought into abutment with the second stopper portion when the rotating lever is situated in the second position, and wherein the second arm is brought into abutment with the spring stopper portion of the base member in such a state that a load is exerted in a direction in which the coil portion is wound so that an inner circumferential surface of the coil portion is pressed against an outer circumferential surface of a side of the support portion which faces the engagement projecting portion.

2. The rotating lever position holding apparatus according to claim 1, wherein the base member comprises an assembling stopper portion with which the first arm of the spring is brought into abutment in such a state that a load is exerted in the direction in which the coil portion is wound so as to prevent the spring from rotating around the support portion when the rotating lever is not assembled onto the base member.

* * * * *